US007642481B2

(12) United States Patent
Kismarton et al.

(10) Patent No.: US 7,642,481 B2
(45) Date of Patent: Jan. 5, 2010

(54) APPARATUS AND METHOD FOR FORMING CORRUGATED MEMBERS

(75) Inventors: Max U. Kismarton, Renton, WA (US); Paul S. Gregg, Seattle, WA (US); Jeff D. Will, Renton, WA (US)

(73) Assignee: The Boeing Company, Chicago, IL (US)

( * ) Notice: Subject to any disclaimer, the term of this patent is extended or adjusted under 35 U.S.C. 154(b) by 526 days.

(21) Appl. No.: 11/464,650

(22) Filed: Aug. 15, 2006

(65) Prior Publication Data

US 2008/0040926 A1 Feb. 21, 2008

(51) Int. Cl.
*B23K 26/20* (2006.01)
*B21D 47/01* (2006.01)

(52) U.S. Cl. ..... 219/121.63; 29/897.35; 72/161; 219/121.64; 219/158; 219/161

(58) Field of Classification Search ..... 29/897.3, 29/897.35; 228/44.3, 47.1, 173.1, 173.6, 228/173.7, 164; 219/121.63, 121.64, 158, 219/161; 72/161
See application file for complete search history.

(56) References Cited

U.S. PATENT DOCUMENTS 2,056,563 A * 10/1936 Eksergian et al. ..... 219/107
2,108,795 A * 2/1938 Budd ..... 219/107
2,510,024 A * 5/1950 Mayer ..... 72/397
2,948,325 A * 8/1960 Welindt ..... 72/313
2,954,068 A * 9/1960 Williamson ..... 72/397
3,612,813 A * 10/1971 Gerath ..... 219/78.12
3,748,889 A * 7/1973 Miller et al. ..... 72/397
3,955,389 A 5/1976 Foster
3,995,080 A 11/1976 Cogburn et al.

(Continued)

FOREIGN PATENT DOCUMENTS

DE 25 03 854 8/1975

(Continued)

OTHER PUBLICATIONS http://www.zeco.at/pg_tbwe_engl1.html; Corrugated Web Beam; Jul. 10, 2002; 1 page.

(Continued)

*Primary Examiner*—Geoffrey S Evans
(74) *Attorney, Agent, or Firm*—Alston & Bird LLP

(57) ABSTRACT

An apparatus and method for forming a stringer are provided. The stringer generally includes a web having a desired corrugated configuration and first and second flanges welded to opposite edges of the web. The apparatus includes a support structure, a strongback that is supported by the support structure, and a plurality of dies that are adjustable relative to the strongback. The strongback defines a corrugated contour surface corresponding to the desired corrugated configuration of the web. The dies define corresponding forming surfaces and are configured to be advanced toward the strongback to thereby form the web to the desired corrugated configuration between the contour surface of the strongback and the forming surfaces of the dies. Further, the apparatus can receive the flanges of the stringer in a predetermined configuration with the web so that the flanges can be welded to the web while the web is supported by the strongback and dies in the desired corrugated configuration.

28 Claims, 11 Drawing Sheets

U.S. PATENT DOCUMENTS

| | | | | | |
|---|---|---|---|---|---|
| 3,995,081 | A | | 11/1976 | Fant et al. | |
| 4,047,354 | A | | 9/1977 | Sutherland | |
| 4,047,411 | A | | 9/1977 | Foster | |
| 4,084,029 | A | | 4/1978 | Johnson et al. | |
| 4,198,018 | A | | 4/1980 | Brault | |
| 4,232,540 | A | | 11/1980 | Cain et al. | |
| 4,250,728 | A | | 2/1981 | King | |
| 4,351,178 | A | | 9/1982 | Uehara et al. | |
| 4,409,771 | A | | 10/1983 | Lowe | |
| 4,437,726 | A | | 3/1984 | Lambert | |
| 4,488,423 | A | | 12/1984 | Newell et al. | |
| 4,490,958 | A | | 1/1985 | Lowe | |
| 4,597,278 | A | | 7/1986 | Hamada et al. | |
| 4,632,862 | A | | 12/1986 | Mullen | |
| 4,635,462 | A | | 1/1987 | Bald | |
| 4,664,580 | A | | 5/1987 | Matoba | |
| 4,803,335 | A | * | 2/1989 | Steen et al. | 219/121.84 |
| 4,967,581 | A | | 11/1990 | Ecrepont | |
| 5,007,225 | A | * | 4/1991 | Teasdale | 52/783.17 |
| 5,116,688 | A | * | 5/1992 | Minamida et al. | 29/897.32 |
| 5,848,765 | A | | 12/1998 | Gillespie | |
| 5,882,462 | A | | 3/1999 | Donecker et al. | |
| 5,937,519 | A | | 8/1999 | Strand | |
| 6,497,131 | B1 | | 12/2002 | Feijen | |
| 6,591,647 | B2 | | 7/2003 | Gerard | |
| 6,834,525 | B2 | | 12/2004 | Leon et al. | |
| 7,340,935 | B2 | * | 3/2008 | Ohtsuka et al. | 72/385 |

FOREIGN PATENT DOCUMENTS

| | | | | |
|---|---|---|---|---|
| DE | 198 02 589 | | | 7/1999 |
| EP | 1 112 788 | | | 12/1999 |
| JP | 5-277597 | A | * | 10/1993 |
| JP | 5-277768 | A | * | 10/1993 |

OTHER PUBLICATIONS

Siokola et al., "Fabrication Tools for Corrugated Web I-Beams," *Modern Steel Construction*; Jul. 1999, 3 pages available at http://www.aisc.org/Content/ContentGroups/Modern_Steel_Construction3/July_1999_Issue/9907_04_corrugatedwebi-beams.pdf.

* cited by examiner

APPARATUS AND METHOD FOR FORMING CORRUGATED MEMBERS

BACKGROUND OF THE INVENTION

1) Field of the Invention

The present invention relates to the forming of members and, more particularly, an apparatus and method for forming corrugated contours in a member, such as a metal web that is disposed between flanges to produce a stringer or beam.

2) Description of Related Art

Corrugated members are widely used for a variety of applications. For example, metal structural panels used in vehicles, buildings, and containers can be corrugated to provide an increased resistance to bending or buckling relative to flat sheets. A corrugated web can be used to form a structural component such as a beam or stringer. For example, a corrugated stringer, which includes a corrugated web that extends between top and bottom flanges, can be used in the construction of a larger assembly such as an aircraft wing or fuselage. The profile of such a corrugated member typically defines wave-like sinusoidal contours, which affect the rigidity and other structural characteristics of the member. Relative to a stringer with a planar web, the corrugated stringer can generally provide greater rigidity, greater strength, and/or decreased weight.

According to one conventional method of forming a corrugated stringer, the web is pre-corrugated by conventional forming methods and then welded to the flanges. The web typically is characterized by some "spring back." That is, if the web is elastically and plastically deformed from a flat configuration to the corrugated configuration, the web may then return partially from its formed shape when the forming forces are removed. In addition, the amount of spring back can vary throughout the web and throughout different webs, e.g., depending on variations in the web thickness or other properties. When the pre-corrugated web is welded to the flanges, any spring back in the web can result in the web having a configuration that differs from the desired configuration. In some cases, the amount of expected spring back can be calculated or otherwise determined so that the web can be formed to a shape that, after spring back, conforms to the desired configuration. However, an accurate determination of spring back can be difficult or impossible and can add to the cost and complexity of the manufacturing process. Thus, in some cases, the web may not be lined up and welded with the flanges in the desired configuration, and the desired configuration of the stringer may not be achieved.

The manufacturing operation of such corrugated stringers can be further complicated by the use of materials with special forming or processing requirements and characteristics. For example, welding of some materials such as titanium generally requires a controlled environment to prevent undesired oxidation or other chemical effects to the material during welding. For this reason, titanium is often welded in a vacuum chamber. That is, titanium components are arranged in a vacuum chamber, the chamber is closed, air is evacuated from the chamber, and then the welding operation is performed. This evacuation method increases the time and expense for welding.

Thus, there exists a need for an improved apparatus and method for forming corrugated contours in a member and for welding members, e.g., for the manufacture of corrugated stringers or beams and the like.

BRIEF SUMMARY OF THE INVENTION

According to one embodiment, the present invention provides an apparatus for forming a stringer that includes a web having a desired corrugated configuration and extending between first and second flanges welded thereto. The apparatus includes a support structure and a strongback that is supported by the support structure. The strongback defines a corrugated contour surface corresponding to the desired corrugated configuration of the web. For example, the surface can be a continuous contour surface, such as a sinusoidal contour with a plurality of minimums and maximums, that extends in a generally longitudinal direction from a first end of the strongback to a second end of the strongback.

A plurality of dies is adjustably supported by the support structure. For example, the support structure can define a linearly adjustable track support for each die so that each die is configured to be adjusted on the support structure in a direction generally perpendicular to a longitudinal direction of the strongback between retracted and advanced positions. Each die is configured to be advanced toward the strongback to thereby form the web to the desired corrugated configuration between the contour surface of the strongback and the forming surfaces of the dies, and one or more actuators can be configured to independently adjust each of the dies toward the strongback to successively form a plurality of corrugations in the web. Each of the dies defines a forming surface that corresponds to a portion of the contour surface of the strongback. For example, the forming surface of each die can correspond to about one sinusoidal cycle of the contour surface of the strongback. A radius of curvature along the forming surface of each die can be different than a radius of curvature at a corresponding location along the contour surface of the strongback so that the forming surfaces of the dies are offset from the contour surface of the strongback by a uniform distance when each of the dies is advanced toward the strongback.

The strongback and dies are also configured to receive the flanges in a predetermined configuration with the web so that the flanges can be welded to the web while the web is supported by the strongback and dies in the desired corrugated configuration. For example, the apparatus can include three or more dies that are arranged in a side-by-side configuration, with the forming surfaces of the dies extending in a generally longitudinal direction of the strongback. Each die can be adjustable to a retracted position such that the apparatus is configured to receive a linear web member between the forming surfaces of the dies and the contour surface of the strongback. In some cases, a controller can be configured to automatically adjust the dies toward the strongback in a predetermined order.

The apparatus can also include a welding tool that is configured to weld each flange to the web while the web is supported between the forming surfaces of the dies and the contour surface of the strongback. For example, the welding tool can be a laser welder that is configured to provide a laser beam on each flange at a position opposite the web and thereby weld the flange to the web. In some cases, the laser welding can be performed without the use of a filler material, thereby reducing the cost and complexity of the operation. A controller can be configured to adjust the power and/or speed of motion of the welding tool to thereby control the operation of the welding tool according to at least one of a location of the welding tool along the support structure and a physical parameter of the stringer along the length thereof.

According to one embodiment, the apparatus includes a gas chamber that is configured to be adjusted along a length of the strongback with the welding tool. The gas chamber defines an opening directed toward one of the flanges and the web supported by the strongback and dies. A gas source is configured to deliver a gas, typically an inert gas, to the gas chamber during operation of the welding tool so that the chamber is maintained substantially full of the gas and each flange is welded to the web in a local environment of the gas. Further, the strongback and dies can define channels along the longitudinal direction of the apparatus, and a gas source can be configured to deliver a gas into the channels. The provision of an inert gas to local regions of the flanges and webs where weld joints are to be formed can avoid the necessity and associated expense of a large vacuum chamber for receiving the entire flanges and webs during welding.

The present invention also provides a method for forming a corrugated contour, such as a sinusoidal contour, in a member. The method includes providing a strongback and a plurality of dies supported by a support structure. For example, the contour surface of the strongback can be provided to extend continuously in a generally longitudinal direction from a first end of the strongback to a second end of the strongback. The continuous contour surface can be provided with a sinusoidal contour having a plurality of minimums and maximums, and the forming surface of each die can correspond to about one sinusoidal cycle of the contour surface of the strongback.

A web is disposed between a corrugated contour surface of the support structure and a forming surface defined by each of the dies. Each of the dies is adjusted toward the strongback from a retracted position to an advanced position to thereby form the web to the desired corrugated configuration between the contour surface of the strongback and the forming surfaces of the dies. Each die can be adjusted independently toward the strongback to thereby successively form a plurality of corrugations in the web. In one embodiment, at least three of the dies are arranged in a side-by-side configuration, with the forming surfaces of the dies extending in a generally longitudinal direction of the strongback, and the apparatus is configured to receive a linear web member between the forming surfaces of the dies and the contour surface of the strongback with the dies retracted. For example, each die can be adjusted along a linearly adjustable track defined by the support structure in a direction generally perpendicular to a longitudinal direction of the strongback between the retracted and advanced positions. The adjustment of the dies can be controlled with a controller, e.g., to automatically adjust the dies toward the strongback in a predetermined order.

The first and second flanges are welded to opposite edges of the web while the web is supported between the strongback and dies in the desired corrugated configuration. For example, a welding tool can move along the edge of the web generally along a longitudinal direction of the support structure. The power and/or speed of motion of the welding tool can be adjusted to thereby control the operation of the welding tool according to a location of the welding tool along the support structure and/or a physical parameter of the stringer along the length thereof. The welding operation can be performed by providing a laser beam on each flange at a position opposite the web to thereby laser weld each flange to the web. Further, in one embodiment, a gas chamber is adjusted along a length of the strongback with the welding tool. The gas chamber defines an opening directed toward one of the flanges and the web supported by the strongback and dies, and a gas is delivered to the chamber during operation of the welding tool to maintain the chamber substantially full of the gas so that each flange is welded to the web in a local environment of the gas. A gas can also be delivered into channels defined by the strongback and dies extending in the longitudinal direction of the apparatus.

In some cases, the apparatus and method can be used without pre-forming (or without substantial pre-forming) of the web and flanges. That is, the web and flanges can be provided in conventional stock shapes and configurations. Further, the forming operations of the present invention can be performed without significant pre-heating of the web and flanges. Thus, the costs, time, and tooling associated with pre-forming and pre-heating can be reduced or eliminated, and the apparatus and method of the present invention can provide for variable wave geometry in the finished member, thereby increasing the shaping flexibility or versatility of the apparatus and method.

BRIEF DESCRIPTION OF THE SEVERAL VIEWS OF THE DRAWINGS

Figure 2:
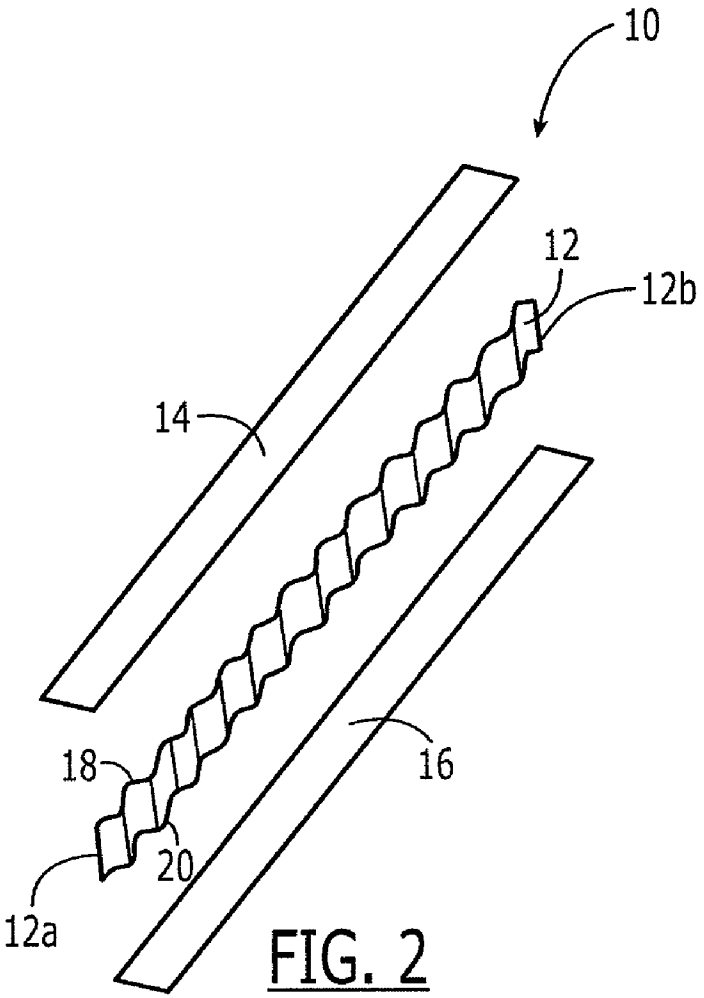
Figure 1:
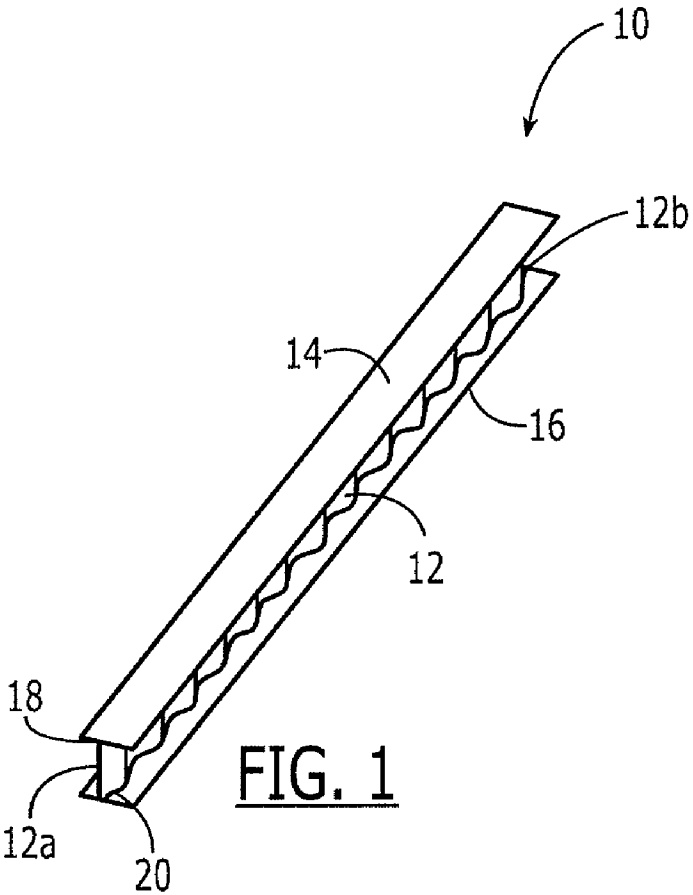
Figure 3:
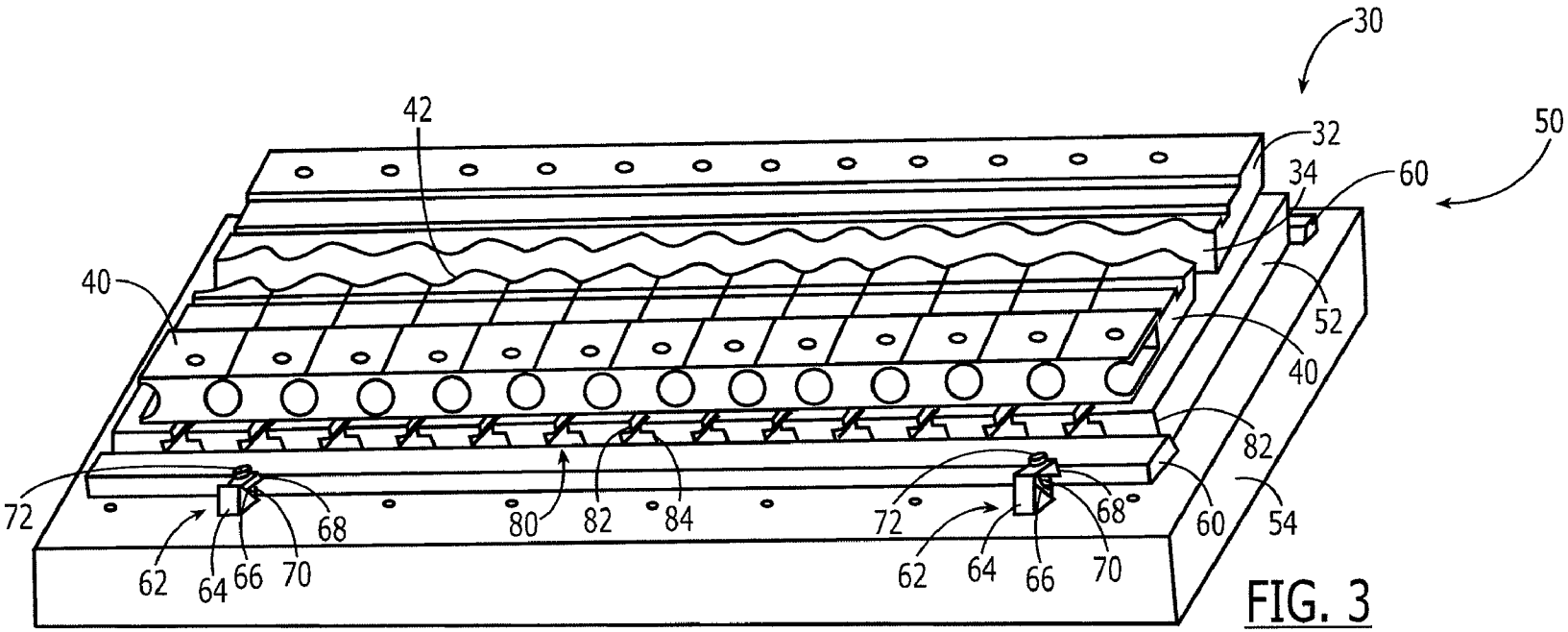
Figure 4:
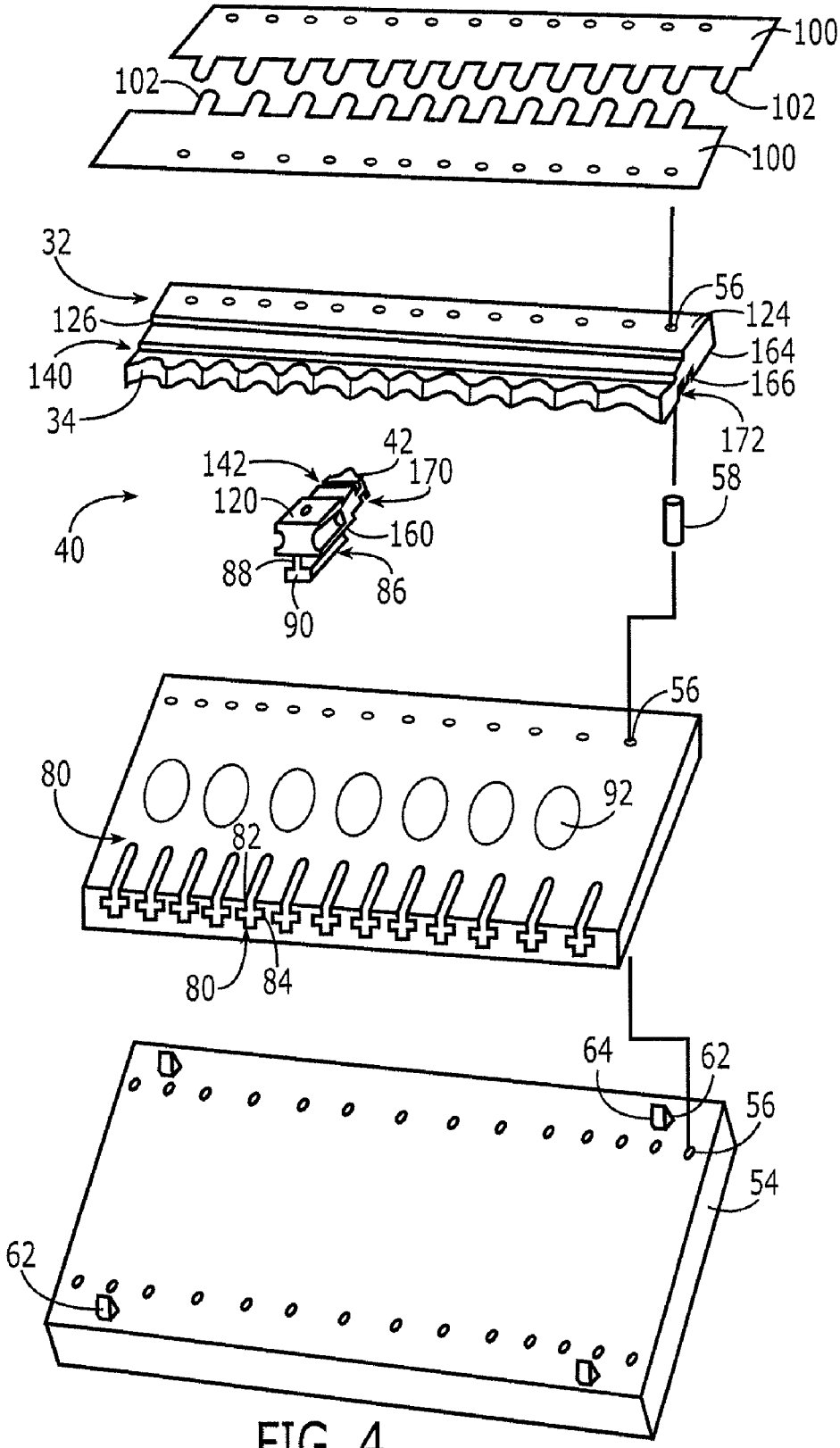
Figure 5:
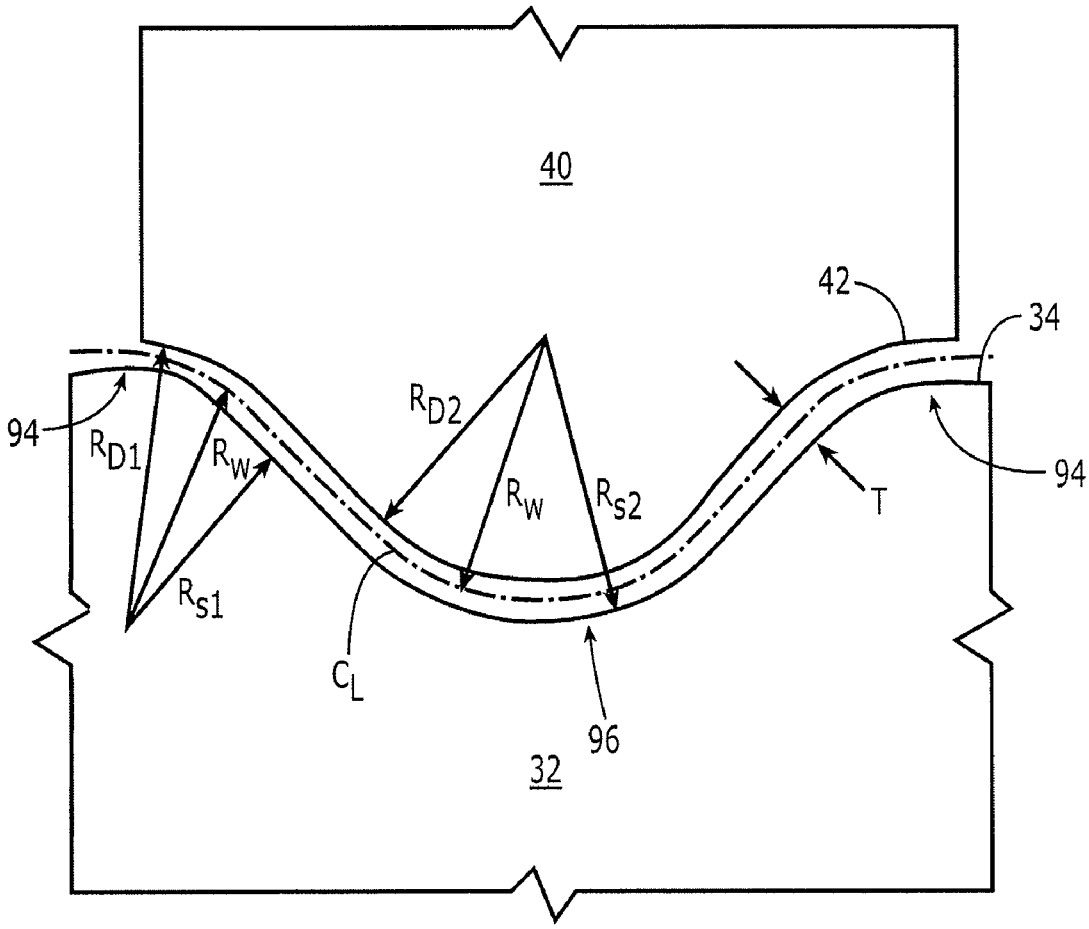
Figure 6:
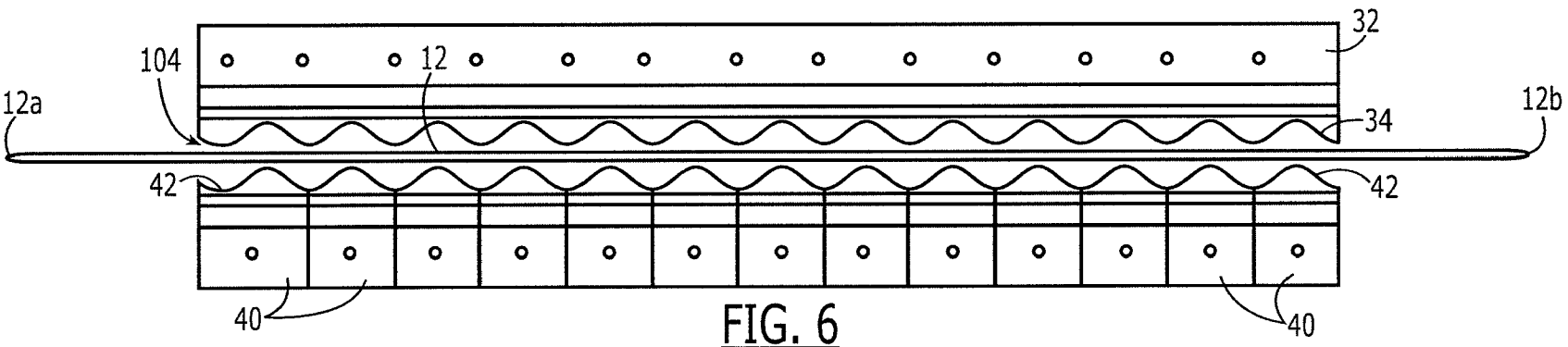
Figure 7:
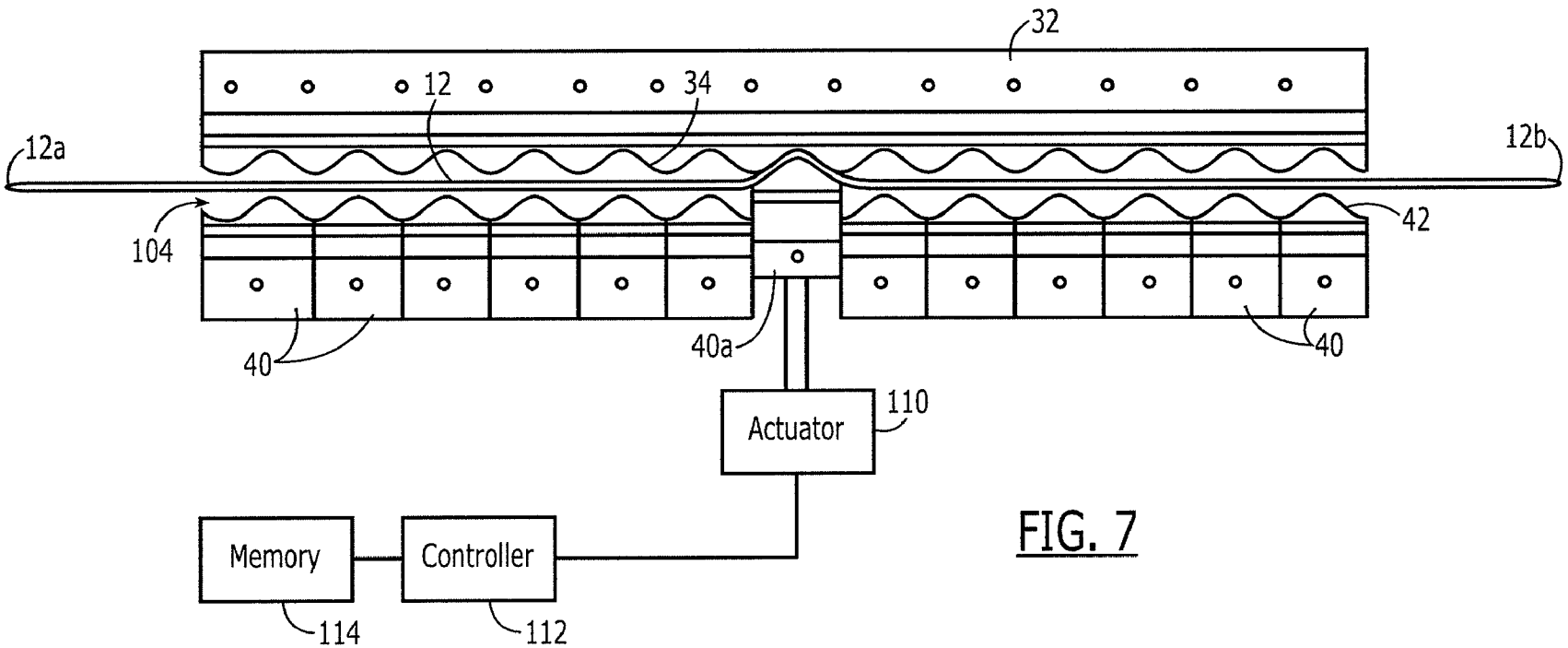
Figure 8:
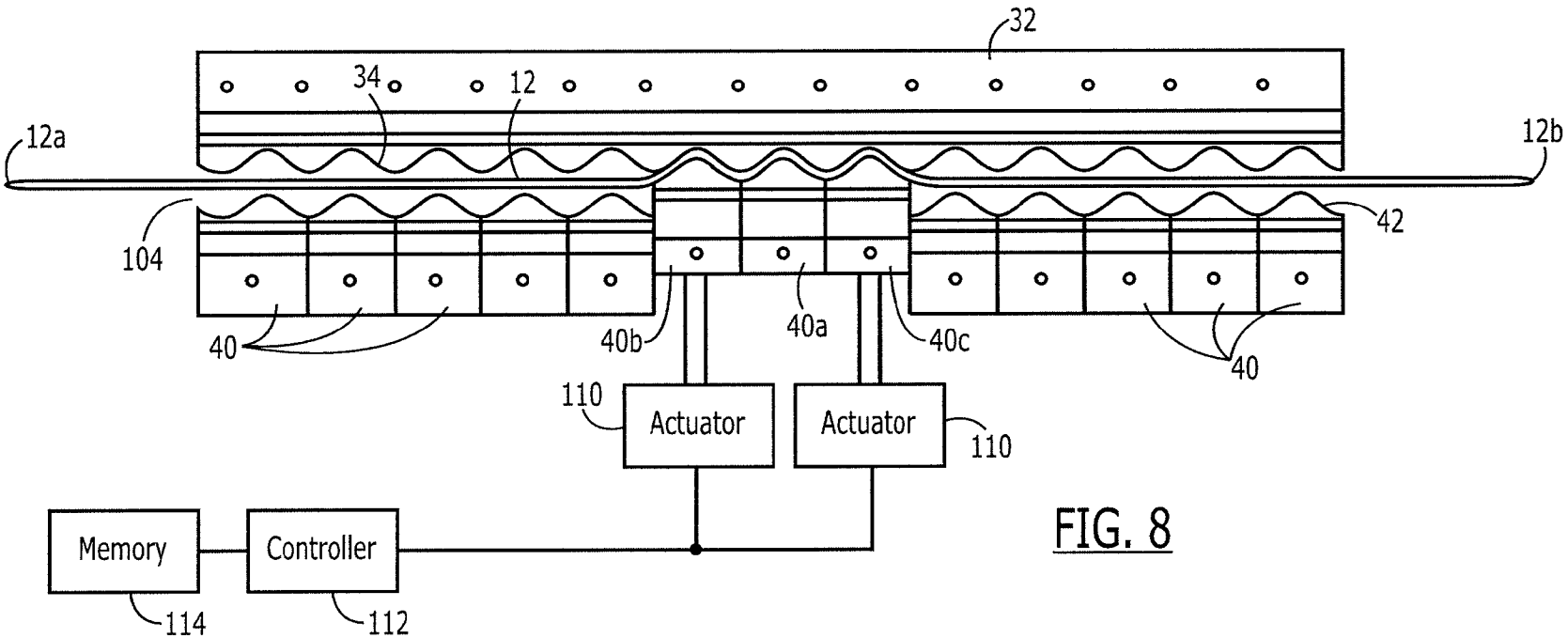
Figure 9:
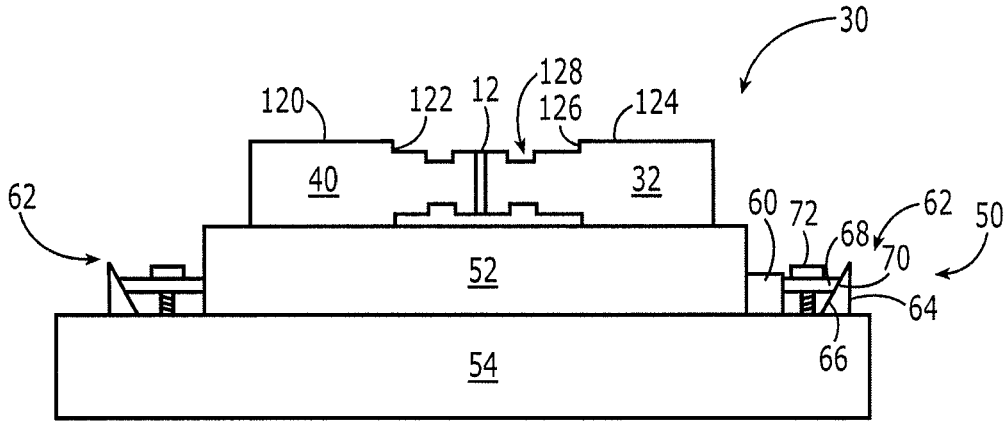
Figure 10:
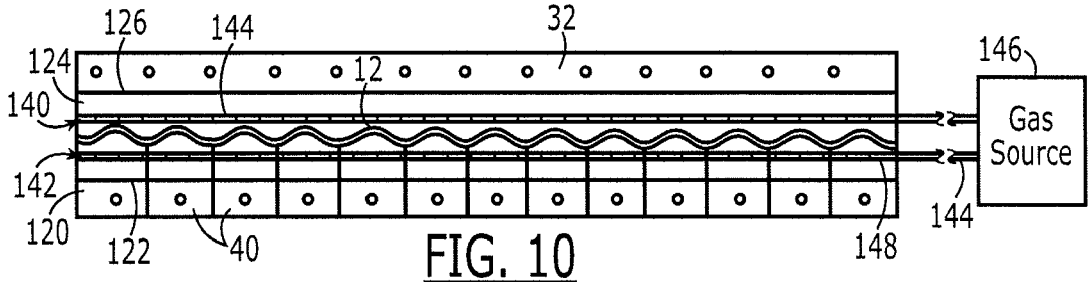
Figure 11:
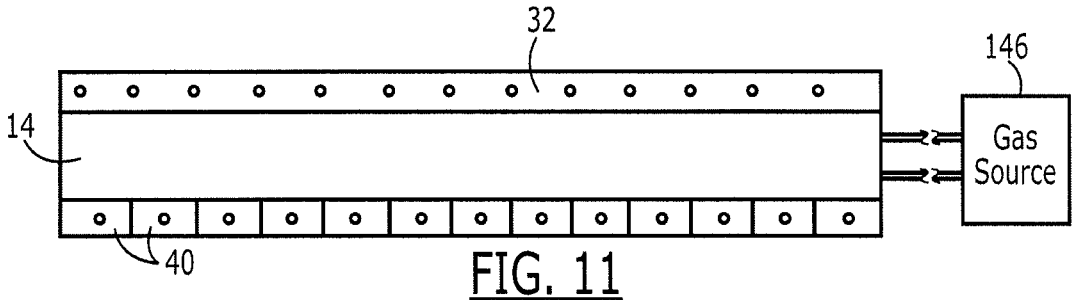
Figure 12:
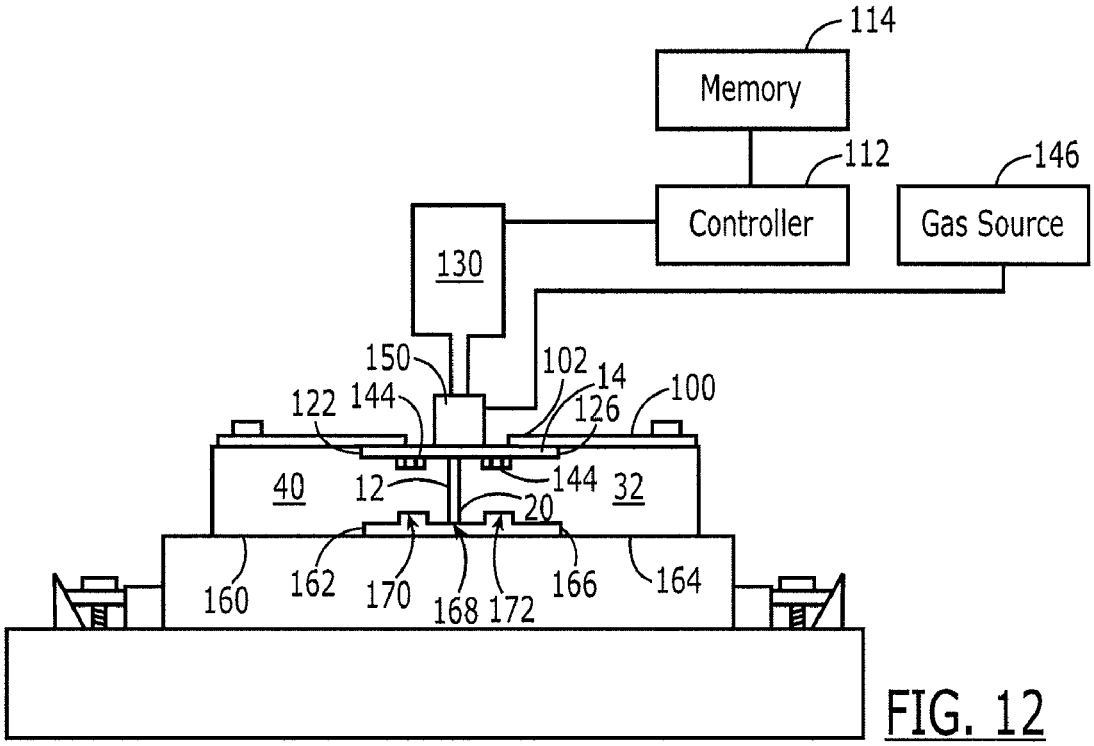
Figure 13:
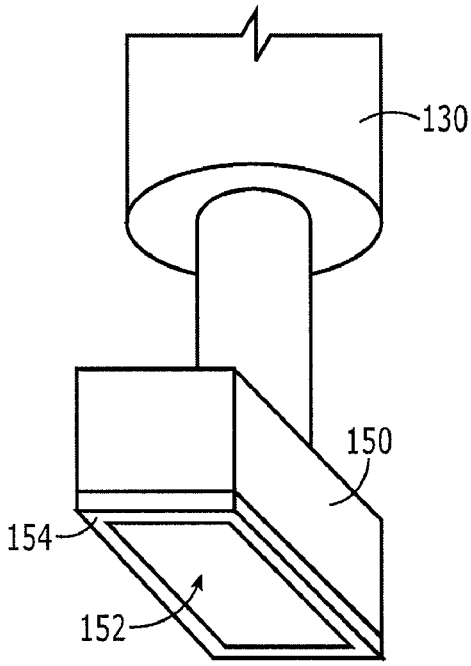
Figure 14:
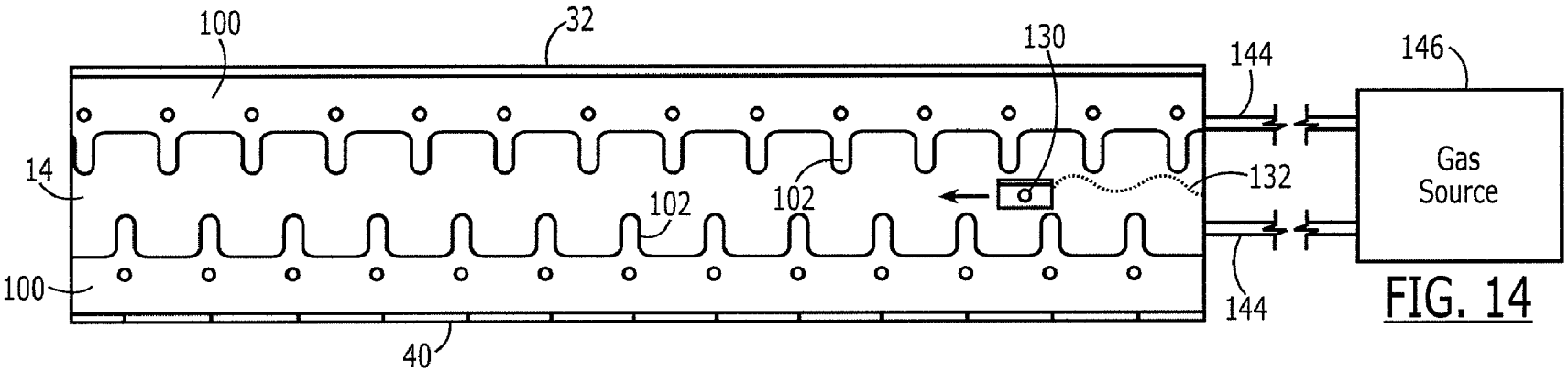
Figure 15:
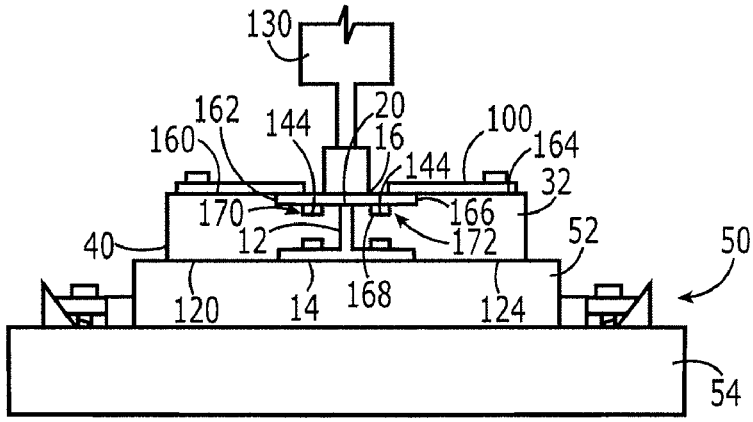
Figure 16:
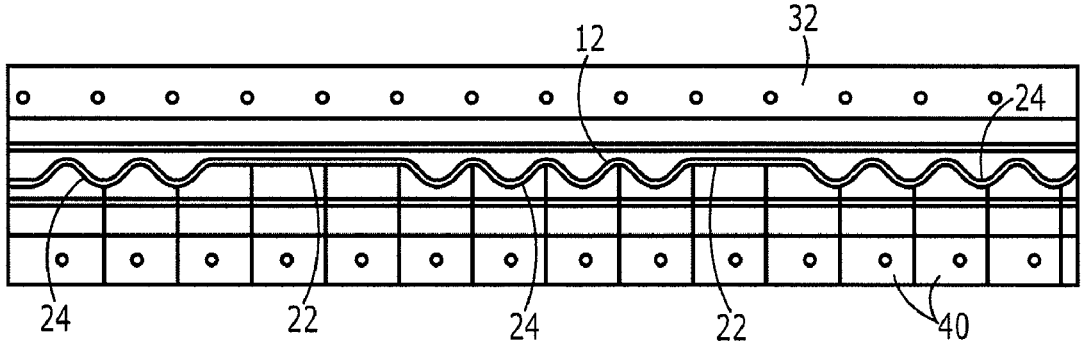

Having thus described the invention in general terms, reference will now be made to the accompanying drawings, which are not necessarily drawn to scale, and wherein:

FIG. 1 is a perspective view illustrating a corrugated stringer produced according to one embodiment of the present invention;

FIG. 2 is a perspective view illustrating the corrugated web and flat flanges of the corrugated stringer of FIG. 1 in an unassembled configuration;

FIG. 3 is a perspective view illustrating an apparatus for forming a corrugated stringer according to one embodiment of the present invention;

FIG. 4 is a perspective view illustrating the apparatus of FIG. 3 in an unassembled configuration;

FIG. 5 is a diagrammatic view illustrating the curvature along the forming surface of one of the dies and a corresponding portion of the contour surface of the strongback;

FIG. 6 is a plan view partially illustrating the apparatus of FIG. 3 with each of the dies in a retracted position;

FIG. 7 is a plan view partially illustrating the apparatus of FIG. 3 with one of the dies in an extended position;

FIG. 8 is a plan view partially illustrating the apparatus of FIG. 3 with three of the dies in an extended position;

FIG. 9 is an elevation view partially illustrating the apparatus of FIG. 3 with all of the dies in an extended position;

FIG. 10 is a plan view partially illustrating the apparatus of FIG. 3 with all of the dies in an extended position;

FIG. 11 is a plan view partially illustrating the apparatus of FIG. 3 with a flange disposed against the corrugated web;

FIG. 12 is an elevation view partially illustrating the apparatus of FIG. 3 with the flange being welded to the corrugated web;

FIG. 13 is a perspective view illustrating the gas chamber used with the welding tool of the apparatus of FIG. 12;

FIG. 14 is a plan view partially illustrating the apparatus of FIG. 3 with the flange being welded to the corrugated web;

FIG. 15 is an elevation view similar to FIG. 12, with the first flange welded to the corrugated web and the second flange configured to be welded to the web; and FIG. 16 is a plan view partially illustrating an apparatus according to another embodiment of the present invention for forming a stringer with a web having corrugated portions and uncorrugated portions.

DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, there is illustrated a corrugated stringer 10 formed according to one embodiment of the present invention. For purposes of illustrative clarity, the corrugated stringer 10 is shown in an unassembled configuration in FIG. 2. As illustrated, the corrugated stringer 10 includes a web 12 that defines a desired corrugated configuration. The web 12 extends between first and second flanges 14, 16 that are welded thereto. That is, as shown in FIG. 1, the first flange 14 is welded to a first edge 18 of the web 12, and the second flange 16 is welded to a second edge 20 of the web 12.

The stringer 10 of the present invention is typically used in a larger assembly, with the stringer 10 supporting the members of the assembly. For example, the stringer 10 can be provided as an elongate beam to which other beams and/or sheets of material are connected. In particular, the stringer 10 can be used to support the skin members of an aircraft wing or fuselage or the floor members of an aircraft. Alternatively, the stringer 10 can support other structures, including other aircraft and other vehicles, buildings and other edifices, and the like.

The web 12 and flanges 14, 16 can be formed of various materials, typically metals. In one embodiment, the web 12 and flanges 14, 16 are formed of titanium or titanium alloys. Alternatively, one or more of the members 12, 14, 16 can be formed of other metals such as aluminum, steels, and the like. The materials for the web 12 and flanges 14, 16 can be selected according to the desired application for the stringer 10. Further, the members 12, 14, 16 can be dimensioned according to the intended application, e.g., by providing relatively thick webs or relatively thick portions of a web that is otherwise thinner to provide additional strength or rigidity at particular locations in the stringer 10, such as near points of connection to other members in an assembly.

In the illustrated embodiment, the flanges 14, 16 are flat and the web 12 defines a sinusoidal corrugated contour, i.e., the contour defines a repeating generally sinusoidal contour or pattern with a profile that has a plurality of a minimums and maximums. In other embodiments, the flanges 14, 16 and/or web 12 can be formed to other configurations. For example, in some cases, the web 12 and flanges 14, 16 can be curved about one or more axes so that the resulting stringer 10 can be used to support a curved wing or other assembly.

FIG. 3 illustrates an apparatus 30 for forming a corrugated stringer 10 according to one embodiment of the present invention. The apparatus 30 generally includes tooling members such as a strongback 32 and a plurality of dies 40 that are supported by a support structure 50. The tooling members can be formed of conventional tooling materials, such as metals, to provide the strength and/or rigidity needed for a particular forming operation. The strongback 32 defines a corrugated contour surface 34 that corresponds to the desired corrugated configuration of the web 12, and each of the dies 40 defines a forming surface 42 that corresponds to a portion of the contour surface 34 so that the dies 40 can be adjusted toward the strongback 32 to form the corrugated web 12 therebetween. Further, after the web 12 has been corrugated, the flanges 14, 16 can be received by the apparatus 30 and supported in a predetermined relationship with the web 12 and welded thereto. Thus, the configuration in which the web 12 and flanges 14, 16 are welded can be closely controlled so that the resulting stringer 10 has the desired shape. In the illustrated embodiment, the strongback 32 extends in a longitudinal direction such that the resulting stringer 10 also extends along a longitudinal direction; however, in other embodiments, the strongback 32 can instead define a curved or otherwise non-linear shape, e.g., for forming a stringer with a corresponding non-linear configuration.

Various members of the apparatus 30 are selectively illustrated in an unassembled configuration in FIG. 4 for purposes of illustrative clarity. As shown, the strongback 32 and the dies 40 (only one shown in FIG. 4) are configured to rest on a support member 52 of the support structure 50, and the support member 52, in turn, rests on a support table 54. The support member 52 can be connected to the support table 54 and the strongback 32, so that the support member 52 is rigidly fixed in location relative to the support table 54. In this regard, the strongback 32, the support member 52, and/or the support table 54 can define holes 56 for receiving connecting members, such as cylindrical rod-shaped pins 58 and/or threaded bolts. As shown in FIG. 3, the support member 52 can be positioned on the table 54 between parallel rails 60, and the rails 60 can be aligned and maintained in position by adjustable clamping devices 62. Each clamping device 62 includes a protrusion 64 rigidly fixed to the table 54 that defines an angled surface 66, and an adjustable clamp member 68 that defines a corresponding angle 70. A bolt 72 is disposed through the clamp member 68 and threaded into a hole in the table 54. As the bolt 72 is tightened, the adjustable clamp member 68 is adjusted toward the table 54 and also toward the rail 60 so that the clamp member 68 abuts the rail 60 and urges the rail 60 against the support member 52.

The support member 52 is structured to adjustably support the dies 40, e.g., so that each die 40 can be adjusted toward the strongback 32 from a retracted position to an extended position. In particular, the support member 52 defines a plurality of tracks along which the dies 40 are adjusted. In the illustrated embodiment, each track is defined by a slot 80 that extends from one end 82 of the support member 52 partially through the support member 52 in a direction toward the strongback 32. Each slot 80 is characterized by a cross-shaped cross-sectional shape. That is, each slot 80 has a narrow portion 82 and a relatively wider portion 84. Similarly, each die 40 has a rail 86 extending therefrom with a T-shaped cross-section, i.e., a relatively narrow portion 88 that corresponds to the narrow portion 82 of the respective slot 80 and a relatively wider portion 90 that corresponds to the wider portion 84 of the slot 80. Thus, the rails 86 and slots 80 provide a linearly adjustable track support for each die 40 so that the dies 40 are slidably connected to the support member 52 and constrained by the support member 52 to adjust between the extended position and the retracted position. The dies 40 are typically adjustable in a direction that is generally perpendicular to a longitudinal direction of the strongback 32, though the dies 40 can be adjusted at angles relative thereto in some embodiments. Various other types of connections can be effected between the dies 40 and the support member 52 and/or the table 54. Bores 92 can be provided in the support member 52 and/or the other members to reduce the total material of the apparatus 30 and thereby reduce the weight thereof.

Any number of the dies 40 can be provided. Typically, the apparatus 30 includes at least three of the dies 40, and the dies 40 are arranged in a side-by-side configuration with the forming surfaces 42 of the dies 40 extending in a generally longitudinal direction of the strongback 32. The forming surface 42 of each die 40 corresponds to a portion of the contour surface 34 of the strongback 32. In particular, the forming surface 42 of each die 40 can correspond to about one sinusoidal cycle of the contour surface 34 of the strongback 32, e.g., such that the forming surface 42 of each die 40 corresponds to a portion of the contour surface 34 of the strongback 32 that extends between two successive maximums.

The forming surface 42 of the die 40 can define a curve that is exactly the same as the curve of the corresponding portion of the contour surface 34. More typically, however, the forming surface 42 defines a curvature that is slightly different than the corresponding portion of the contour surface 34. In particular, the radius of curvature along the forming surface 42 can be slightly greater or slightly less than the radius of curvature defined by the corresponding portion of the contour surface 34, and the slight different in curvature can facilitate the operation of the apparatus 30. For example, FIG. 5 illustrates one embodiment of the present invention in which the radius of curvature of the strongback 32 and dies 40 varies. In particular, at a portion of the contour surface 34 of the strongback 32 that defines a maximum 94, the radius of curvature of the contour surface 34, designated $R_{S1}$, is less than a radius of curvature of a corresponding portion of the forming surface 42 of the die 40, designated $R_{D1}$. At a portion of the contour surface 34 of the strongback 32 that defines a minimum 96, the radius of curvature of the contour surface 34, designated $R_{S2}$, is greater than a radius of curvature of a corresponding portion of the forming surface 42 of the die 40, designated $R_{D2}$. The radius of curvature of a centerline $C_L$ between the two surfaces 34, 42 and, hence, the radius of curvature of a portion of the web 12 that is formed between the corresponding portions of the surfaces 34, 42, which is designated $R_W$, is the same at the locations of the maximums 94 and minimums 96 of the contour surface 34. The radii of curvature along each of the forming surface 42 and the contour surface 34 can be provided so that the offset distance between the surfaces 34, 42 is uniform when the dies 40 are extended. That is, with the dies 40 in the extended position, a space of uniform thickness, which is typically the thickness of the web 12, and which is designated T, is provided between the surfaces 34, 42. By the term sinusoidal, it is meant that each of the surfaces 34, 42 is curved to define a corrugated shape that generally resembles a sinusoid pattern alternating between minimum and maximums, but the surfaces 34, 42 need not adhere strictly to a sinusoid pattern.

Plates 100 are provided for selectively installing on the strongback 32 and the dies 40, typically after the corrugated web 12 is formed and before the flanges 14, 16 are welded to the web 12. As illustrated, the plates 100 can define fingers 102 that extend onto portions of the flanges 14, 16 where welding is not to be performed so that the plates 100 can support the flanges 14, 16 in the desired configuration without interfering with the operation of welding the flanges 14, 16 to the web 12.

FIG. 6 illustrates the strongback 32 and the dies 40 in the retracted position, i.e., such that the forming surfaces 42 of the dies 40 are retracted from the strongback 32. In the retracted position, the forming surfaces 42 of the dies 40 and the contour surface 34 of the strongback 32 are spaced from one another to define a gap 104 therebetween in which a web member can be received. In particular, each die 40 can be adjustable to a position that is sufficiently retracted from the strongback 32 so that the apparatus 30 is configured to receive a linear sheet- or plate-like member for the web 12 between the forming surfaces 42 of the dies 40 and the contour surface 34 of the strongback 32, as shown in FIG. 6. As each die 40 is adjusted to its extended position, the web 12 is formed between the forming surface 42 of the die 40 and the corresponding portion of the contour surface 34 of the strongback 32.

Various devices can be provided for adjusting the dies 40. For example, one or more actuators 110 (FIGS. 7 and 8) can be provided for adjusting the dies 40. Each actuator 110 can be electric, hydraulic, pneumatic, or otherwise powered. An operator can adjust the dies 40, e.g., by operating the actuator 110 or by manually adjusting a mechanical linkage to adjust the dies 40. Alternatively, the apparatus 30 can include a controller 112 that automatically operates the dies 40 according to a list of forming instructions. For example, the controller 112 can be programmed with a set of instructions, can learn according to positions of the dies 40 that are manually set by an operator, and/or can calculate forming instructions for controlling the dies 40 according to instructions that include such characteristics as the dimensions of the web 12, the desired contour for the web 12, the dimensions of the components of the apparatus 30, and the like. The actuator 110 can be configured to adjust the dies 40 to predetermined positions, and/or the actuator 110 can be configured to adjust the dies 40 with a force that is less than a maximum. The controller 112 can include a memory device 114 for storing the instructions. Thus, the operator can use the apparatus 30 to form multiple similar stringers 10 as desired with minimal reconfiguration of the apparatus 30 being required, and the apparatus 30 can be adapted to be quickly and easily modified for forming dissimilar stringers 10 according to different instructions.

FIG. 7 illustrates the apparatus 30 with one of the dies 40 adjusted to the extended position by the actuator 110. In the illustrated embodiment, the die 40 in the center of the group of dies 40, indicated individually by reference numeral 40*a*, is extended first while each of the other dies 40 remains in the retracted position. Thereafter, dies 40 adjacent to the extended die 40 are also extended. The same actuator 110 can be used to extend the various dies 40 successively, or different actuators 110 can be provided for extending each of the dies 40. In either case, the dies 40 can be extended independently. That is, one or more of the dies 40 can be extended while other dies 40 remain retracted, such that a plurality of corrugations is successively formed in the web 12. For example, as shown in FIG. 8, the actuators 110 adjust two of the dies 40, indicated individually by reference numerals 40*b* and 40*c*, to the extended position, the two dies 40*b*, 40*c* being extended simultaneously or successively.

While the present invention is not limited to any particular theory of operation, it is believed that the forming of the web 12 is facilitated by independent adjustability of the dies 40 because the forming forces would be greater if all of the dies 40 were to instead move in unison. More particularly, moving all of the dies 40 in unison would not allow the same degree of motion of the web 12 during forming as occurs in the illustrated embodiment. In this regard, it can be seen that, as each die 40 is used to form a portion of the web 12, the ends 12*a*, 12*b* of the web 12 are adjusted inward toward the gap 104 between the strongback 32 and the dies 40. In other words, the unformed portions of the web 12 move inward toward the advanced dies 40 as the dies 40 are successively advanced. In some cases, the web 12 can be provided with a length that is greater than the length of the strongback 32 so that the ends 12*a*, 12*b* of the web 12 extend from the gap 104 before forming. Then, as the web 12 is formed, the ends 12*a*, 12*b* can move inward and, in some cases, move into the gap 104 during forming (FIG. 10). In the illustrated embodiment, the dies 40 are provided as separate members that can be adjustable independently, though in other embodiments, the dies 40 can instead be connected, e.g., by providing the dies as a series of protrusions or cogs extending from a rotatable wheel, such that each of the dies can be adjusted individually against the web 12 to form the corrugations or waves at different times.

In other embodiments of the present invention, the dies 40 can be advanced in other orders. For example, the die 40 at either end of the group of dies 40 can be advanced first, and then the dies 40 can be successively advanced, each die 40 closest to the advanced dies 40 being advanced before the other retracted dies 40. In that case, each die 40 can be advanced individually, i.e., while the other dies 40 remain retracted or advanced. Alternatively, in the embodiment illustrated in FIGS. 7 and 8, where the center die 40*a* is advanced first, two dies 40 can be advanced at the same time, i.e., one retracted die 40 on each side of the extended dies 40 being advanced at the same time.

The web 12 is typically formed to its desired configuration when all of the dies 40 are advanced. In the illustrated embodiment of FIG. 10, the contour surface 34 of the strongback 32, the corresponding forming surfaces 42 of the dies 40, and, hence, the resulting contour of the web 12 formed therebetween, are characterized by a sinusoidally corrugated shape that is continuous along the length of the strongback 32 between the longitudinal ends of the strongback 32. In other embodiments, the desired shape of the web 12 can have other configurations. For example, the desired shape of the web 12 may be corrugated in some portions and flat in other portions, the sinusoidal pattern of the desired shape can vary in wavelength or amplitude throughout the length of the web 12, and/or the web 12 can define other arcs, angles, flats, or the like. Similarly, the contour surface 34 of the strongback 32 and the forming surfaces 42 of the dies 40 can be provided with corresponding shapes to thereby form the web 12 to the desired shape.

With the dies 40 advanced and the web 12 supported between the dies 40 and the strongback 32, the web 12 is supported in its desired configuration. The apparatus 30 is also configured to support the flanges 14, 16 so that the flanges 14, 16 can be welded to the web 12. In particular, as shown in FIG. 9, the strongback 32 and/or the dies 40 can be configured to at least partially receive the flanges 14, 16 so that the flanges 14, 16 are maintained in a predetermined relationship with the web 12. In this regard, each of the dies 40 and the strongback 32 can define stepped surfaces for receiving the flanges 14, 16 on opposite sides of the web 12. In particular, on a first side 120 of each die 40, the die 40 defines an edge 122 extending generally in a plane perpendicular to the motion of the dies 40. Similarly, a first side 124 of the strongback 32 also defines an edge 126 extending parallel to the edges 122 of the dies 40. When the dies 40 are in the advanced position, the edges 122, 126 define therebetween a recess or cavity 128 for receiving the first flange 14. The distance between the edges 122, 126, when the dies 40 are advanced, is typically equal to the width of the first flange 14 so that the first flange 14 can be received in the recess 128 in a predetermined configuration relative to the web 12. Thus, as shown in FIGS. 11 and 12, the first flange 14 can be accurately positioned and maintained in the desired position while the flange 14 is welded to the web 12. The first flange 14 can be welded to the web 12 while the web 12 is supported in its desired configuration so that any substantial misalignment or deviation of the web 12 from its desired configuration, such as might occur as a result of spring back of the web 12 after forming, can be prevented.

In the illustrated embodiment, the dies 40 are configured to be adjusted in alternate linear motions that are generally perpendicular to the length of the strongback 32. That is, each die 40 moves alternately in motion having a direction that is generally perpendicular to the strongback 32. In other embodiments, the dies 40 can be configured for other adjustments. For example, each of the dies 40 can be configured to be adjusted through an arcuate path of motion, such that each die 40 is alternately advanced toward the strongback 32 and retracted from the strongback 32. In one embodiment, each of the dies is defined as a tooth or gear that is supported by, and extends radially from, the support structure, which is defined as a wheel or pinion. With the support structure and dies so configured, the support structure can be relatively rolled along the contour surface of the strongback by an actuator with the web 12 between the strongback and support structure so that each die extending from the support structure is alternately advanced against a corresponding portion of the contour surface of the strongback and retracted from the contour surface of the strongback. Thus, the dies successively form the web 12 between the strongback and the support structure.

As illustrated in FIGS. 12 and 14, the first flange 14 can be welded to the web 12 by a welding tool 130 that moves or otherwise adjusts along the length of the web 12 to form a weld joint 132 between the web 12 and the flange 14. The support structure 50 can be configured to maintain the flange 14 in the desired position. For example, the plates 100 can be bolted or otherwise connected to the first sides 120, 124 of the dies 40 and the strongback 32 so that the flange 14 is disposed at least partially between the plates 100 and each of the strongback 32 and dies 40. In particular, appendages or fingers 102 of the plates 100 can extend to overlap the flange 14 and hold the flange 14 in the recess 128. The fingers 102 typically extend in a configuration that does not overlap the portion of the flange 14 that is to be welded to the web 12. Thus, the welding tool 130 can move along the flange 14 or otherwise access the portion of the flange 14 along which the weld joint 132 is to be formed.

The welding tool 130 forms the weld joint 132 between the flange 14 and the web 12. Various types of welding operations can be used to form the weld joint 132, such as thermal welding, fusion welding, friction stir welding, or diffusion bonding and, more particularly, laser welding, electron beam welding, resistance welding, gas arc welding, or the like. In the embodiment illustrated in FIG. 12, a laser welding tool 130 is used to form a laser weld joint 132. The laser welding tool 130 uses a focused beam of radiation energy to heat the flange 14 at a position opposite the web 12 to a temperature sufficient for welding. Various types of laser welding tools 130 can be used. In one embodiment, a 700 watt laser is used to generate a beam of energy that is focused on an area that is about 0.002-0.003 inch in diameter, such that the material of the flange 14 is locally heated to temperatures of about 3000-4000° F. and melted in a small local area. Thus, the laser welding tool 130 can weld a small area of the flange 14 while other areas of the flange 14 are not substantially heated or affected by the welding operation, i.e., such that a heat affected zone formed during the welding operation is relatively small.

An inert gas can be provided in the area where the welding is performed so that the welding operation is performed in a local environment characterized by the inert gas and substantially free of other atmospheric gases. For example, helium can be provided at the location of the welding operation to reduce or eliminate corrosive or other chemical effects that can otherwise occur if the welding operation is performed in standard atmospheric conditions. The use of an inert gas that displaces the oxygen and nitrogen of standard atmospheric gas can simplify the welding operation relative to conventional welding operations that require the welding operation to be performed in a vacuum. The welding operation can be performed in a vacuum or under other controlled conditions; however, it has been found that the use of the inert gas can result in an acceptable weld joint without costly and lengthy vacuum procedures.

The inert gas can be provided to the location of the welding operation in various ways. For example, gas transmission passageways can be disposed in the apparatus 30. As shown in FIG. 10, the first side 124 of the strongback 32 can define a channel 140 extending along the length of the strongback 32, and the first side 120 of each of the dies 40 can also define a channel 142 that extends continuously along the dies 40 when the dies 40 are aligned in the extended position. Tubes 144 can be disposed in each of the channels 140, 142 to deliver a gas from a gas source 146 to the channels 140, 142 and, hence, to the area of the welding operation. Each tube 144 defines a longitudinally extending passage. Outlets or holes 148 along the tubes 144 provide a pathway for the inert gas from the source 146 to flow from the tubes 144 and to fill any spaces proximate the intersection of the web 12 and the flange 14.

While separate members are provided for defining the passageways for the inert gas in the illustrated embodiment, it is also appreciated that the strongback 32 and/or the dies 40 can define integral passageways for directing the gas to the areas of the welding operation. For example, the strongback 32 and the dies 40 can define an internal manifold that, similar to the tubes 144, directs a flow of gas from the source 146 to the vicinity of the web 12 and flanges 14, 16.

A gas can also be provided proximate the flange 14 on the side of the flange 14 that is directed toward the welding tool 130. For example, as shown in FIG. 13, a gas chamber 150 can be provided as a box-like structure with an opening 152 on one side thereof. The opening 152 is directed toward the flange 14 so that the chamber 150, when disposed against the flange 14, defines a substantially closed space. A gas source, which can be the same gas source 146 that provides the gas to the tubes 144, is configured to provide a flow of gas to the chamber 150 to fill the chamber 150 during operation. The welding tool 130 is typically configured to weld inside the chamber 150. That is, the chamber 150 is mounted proximate to a head of the laser welding tool 130 such that the laser welding tool 130 directs a laser beam through the gas in the chamber 150 and onto a portion of the flange 14 that is overlapped by the chamber 150. Thus, the weld joint 132 can be formed within the chamber 150 in a local environment of the inert gas.

An interface material 154 can be provided about the periphery of the opening 152 of the chamber 150 to form a partial seal between the chamber 150 and the flange 14. For example, the interface material 154 can be provided as a plastic strip or a brush that extends around the periphery of the opening 152 and directed toward the flange 14. The gas source 146 can maintain a sufficient flow of gas to the chamber 150 to raise the pressure in the chamber 150 to a pressure that is slightly greater than atmospheric pressure such that a positive flow of the inert gas in the chamber 150 is provided through an interface between the chamber 150 and the flange 14, i.e., through or around the interface material 154, so that entry of atmospheric gas into the chamber 150 during welding is substantially prevented.

Similarly, the second flange 16 can also be welded to the web 12 without removing the web 12 from the apparatus 30. In particular, as shown in FIG. 15, the strongback 32, dies 40, web 12, and the plates 100 can be removed from the support structure 50 and repositioned to provide access to the second edge 20 of the web 12. In particular, the plates 100 can be removed from the strongback 32 and dies 40, and the strongback 32 and dies 40 can be removed from the support structure 50. The strongback 32 and dies 40 can then be turned over and again supported by the support structure 50 so that the first sides 120, 124 of the dies 40 and strongback 32 are directed toward the support table 54 and second sides 160, 164 of the dies 40 and the strongback 32 are directed toward the welding tool 130, with the plates 100 again secured to maintain the position of the second flange 16. The second sides 160, 164 of the dies 40 and the strongback 32 define channels 170, 172 for receiving tubes for delivering an inert gas during welding, i.e., from the gas source 146 via tubes 144. Also, the second sides 160, 164 can define edges 162, 166 with a recess 168 therebetween for receiving the second flange 16 in contact with the second edge 20 of the web 12 opposite the first flange 14. Thus, the second flange 16 can be positioned and welded to the second edge 20 of the web 12 in a manner similar to that described above for the first flange 14, i.e., as shown in FIG. 14 but with the second flange 16 instead of the first flange 14 being welded to the web.

In other embodiments of the present invention, the flanges 14, 16 can be welded to the web 12 without removing or re-orienting the web 12 relative to a support table 54. For example, the flanges 14, 16 can be supported by a support structure 50 that provides sufficient access to both sides of the web 12 so that the flanges 14, 16 can be positioned and welded thereto without moving the web 12. Further, in some cases, the two flanges 14, 16 can be welded to the web 12 at the same time. In this regard, the welding tool 130 can include two lasers, or a single laser can provide a beam that is split into two portions, with a first portion being directed to the first flange 14 and a second portion being directed to the second flange 16 to perform the welding operations. For example, the beam emitted from a Nd:YAG (neodymium-doped yttrium aluminum garnet) laser can be split into two portions for simultaneously welding both of the flanges 14, 16 to the web 12.

The welding operation can be automatically controlled by a control device, such as the controller 112 described above that is used for automatically positioning the dies 40. The controller 112 can operate according to a list of welding instructions that determine such welding parameters as the speed of motion of the welding tool 130 along the apparatus 30, the power provided by the welding tool 130, the particular path of the welding tool 130, the orientation or directionality of the welding tool 130, and the like. The controller can operate the welding tool 130 according to physical parameters of the stringer 10, such as the type of materials used for the stringer 10, the thickness or other dimensions of the various members of the stringer 10, and the like. For example, the controller 112 can be configured to vary the laser power provided for the welding operation according to the thickness of the web 12 and/or flanges 14, 16 along the length thereof. In particular, if the web 12 and/or the flanges 14, 16 include relatively thick and thin portions, the power of the welding tool 130 can be increased when forming the weld joint 132 at relatively thick portions and decreased when forming the weld joint 132 at relatively thin portions.

In some cases, the controller 112 can be configured to control the welding operation according to the position of the welding tool 130 along the web 12 or the support structure 50, such as where the physical parameters of the stringer 10 vary along the length thereof. In this regard, with the web 12 positioned between the strongback 32 and the dies 40 in the as-formed configuration, the location of any portion of the web 12 can be determined according to a position along the strongback 32 and dies 40. Further, with the strongback 32 and dies 40 positioned accurately along the support table 54 or other member of the support structure 50, the location of any portion of the web 12 can also be determined according to a position along the support table 54 or other support structure. Thus, by determining the position of the various features of the web 12 along the support structure 50, the controller 112 can determine the proper operating parameters according to the position of the welding tool 130 along the support structure 50. Accurate control of the welding tool 130 can be important in forming the weld joint 132 at a desired location in the stringer 10. For example, in one embodiment, the web 12 has a thickness of about 0.010-0.015 inch, and the welding tool 130 provides a laser beam that is focused on an area of the flange 14, 16 that is about 0.002-0.003 inch in diameter. If the laser beam is not accurately directed to a portion of the flange 14, 16 that is opposite the web 12, the web 12 may not be welded to the flange 14, 16.

While the corrugated web 12 shown in FIG. 10 defines a sinusoidal pattern with uniformly repeating cycles having maximums and minimums, it is appreciated that the apparatus 30 can also be used to form stringers with other shapes as noted above. The web 12 and/or flanges 14, 16 can vary in thickness and/or size so that the resulting stringer 10 defines a desired configuration. For example, FIG. 16 illustrates a web 12 that is formed from a flat sheet having relatively thick portions 22 and relatively thin portions 24, i.e., a tailored sheet or blank. When formed to the corrugated formation as shown, the web 12 defines corrugated portions and multiple flat portions. In particular, the thin portions 24 of the web 12 are corrugated and the thick portions 22 of the web 12 define flat portions after forming. The flat, thick portions 22 of the web 12 can be provided, e.g., for connecting the web 12 to stanchions, other beams, or the like. The flanges 14, 16 can be connected to the web 12 by welding and, as described above, the operation of the welding tool 130 can be varied according to the web 12. That is, the actuator 110 can move the welding tool 130 along a path that corresponds to each edge 18, 20 of the web 12, including the corrugated and flat portions of the edges 18, 20. Further, the controller 112 can vary the power of the welding tool 130, e.g., so that a relatively less powerful laser beam is provided for welding the thinner, corrugated portions 24 of the web 12 to the flanges 14, 16 and a relatively more powerful laser beam is provided for welding the thicker, uncorrugated portions 22 of the web 12 to the flanges 14, 16. In addition to or as an alternative to varying the power of the welding tool 130, the speed of the welding tool 130 can be varied. For example, the laser beam can move more quickly along each flange 14, 16 when welding each flange 14, 16 to the thinner, corrugated portions 24 and more slowly along each flange 14, 16 when welding each flange 14, 16 to the thicker, uncorrugated portions 22. Similarly, the power or speed of the laser or other welding parameters can be adjusted according to other characteristics of the stringer 10. For example, in cases where one or both of the flanges 14, 16 is provided with a nonuniform thickness throughout, the controller 112 can increase the power and/or decrease the speed of the welding tool 130 when welding relatively thick portions of the flanges 14, 16 to the web 12, and the controller 112 can decrease the power and/or increase the speed of the welding tool 130 when welding relatively thin portions of the flanges 14, 16 to the web 12. In other embodiments, the flanges 14, 16 can vary in thickness or size to achieve a particular configuration in the finished stringer 10.

The weld joints 132 and/or other portions of the stinger 10 can be inspected during or after the formation of the stringer 10. In some cases, such inspection can be performed in a non-destructive manner. For example, non-destructive inspection can be performed by inspection devices that use high speed laser scanning, micro X-ray, or ultrasonic inspection. Such inspection devices can be configured to perform the inspection during manufacture of the stringer 10. For example, the inspection device can be mounted on the head of the laser welding tool 130 or otherwise configured to monitor the welding operation or other aspects of the stringer 10.

Many modifications and other embodiments of the inventions set forth herein will come to mind to one skilled in the art to which these inventions pertain having the benefit of the teachings presented in the foregoing descriptions and the associated drawings. For example, it is appreciated that the stringer and/or its individual components can be subjected to other additional processing operations, such as a thermal cycle for reducing stresses in the members after the welding operation. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for forming a stringer with a web having a desired corrugated configuration and extending between first and second flanges welded thereto, the apparatus comprising:

a support structure;

a strongback supported by the support structure, the strongback defining a corrugated contour surface corresponding to the desired corrugated configuration of the web; and a plurality of dies, each of the dies defining a forming surface corresponding to a portion of the contour surface of the strongback, the dies adjustably supported by the support structure and configured to be advanced toward the strongback to thereby form the web to the desired corrugated configuration between the contour surface of the strongback and the forming surfaces of the dies, wherein the strongback and dies are configured to receive the flanges in a predetermined configuration with the web such that the flanges can be welded to the web while the web is supported by the strongback and dies in the desired corrugated configuration.

2. An apparatus according to claim 1 wherein the strongback defines a continuous contour surface extending in a generally longitudinal direction from a first end of the strongback to a second end of the strongback.

3. An apparatus according to claim 2 wherein the continuous contour surface of the strongback is a sinusoidal contour having a plurality of minimums and maximums.

4. An apparatus according to claim 3 wherein the forming surface of each die corresponds to about one sinusoidal cycle of the contour surface of the strongback.

5. An apparatus according to claim 1, further comprising at least one actuator configured to independently adjust each of the dies toward the strongback such that a plurality of corrugations are successively formed in the web.

6. An apparatus according to claim 1 wherein the apparatus comprises at least three of the dies arranged in a side-by-side configuration, the forming surfaces of the dies extending in a generally longitudinal direction of the strongback, each die being adjustable between an advanced position and a retracted position, the apparatus being configured to receive a linear web member between the forming surfaces of the dies and the contour surface of the strongback when the dies are in the retracted position.

7. An apparatus according to claim 1 wherein the support structure defines a linearly adjustable track support for each die, such that each die is configured to be adjusted on the support structure in a direction generally perpendicular to a longitudinal direction of the strongback between the retracted and advanced positions.

8. An apparatus according to claim 1 wherein a radius of curvature along the forming surface of each die is different than a radius of curvature at a corresponding location along the contour surface of the strongback such that the forming surfaces of the dies are offset from the contour surface of the strongback by a uniform distance when each of the dies is advanced toward the strongback.

9. An apparatus according to claim 1, further comprising a controller configured to automatically adjust the dies toward the strongback in a predetermined order.

10. An apparatus according to claim 1 wherein the strongback and dies define channels along the longitudinal direction of the apparatus, and further comprising a gas source configured to deliver a gas into the channels.

11. An apparatus according to claim 1, further comprising a welding tool configured to weld each flange to the web while the web is supported between the forming surface of the dies and the contour surface of the strongback.

12. An apparatus according to claim 11, further comprising a controller configured to adjust at least one of a power and speed of motion of the welding tool to thereby control the operation of the welding tool according to at least one of a location of the welding tool along the support structure and a physical parameter of the stringer along the length thereof.

13. An apparatus according to claim 11, wherein the welding tool is a laser welder configured to provide a laser beam on each flange at a position opposite the web and thereby weld the flange to the web.

14. An apparatus according to claim 11, further comprising:

a gas chamber configured to be adjusted along a length of the strongback with the welding tool, the gas chamber defining an opening directed toward one of the flanges and the web supported by the strongback and dies; and a gas source configured to deliver a gas to the gas chamber during operation of the welding tool such that the chamber is maintained substantially full of the gas and each flange is welded to the web in a local environment of the gas.

15. A method for forming a stringer with a web having a desired corrugated configuration and extending between first and second flanges welded thereto, the method comprising:

providing a strongback and a plurality of dies supported by a support structure;

disposing the web between a corrugated contour surface of the support structure and a forming surface defined by each of the dies;

adjusting each of the dies toward the strongback from a retracted position to an advanced position and thereby form the web to the desired corrugated configuration between the contour surface of the strongback and the forming surfaces of the dies; and welding the first and second flanges to opposite edges of the web while the web is supported between the strongback and dies in the desired corrugated configuration.

16. A method according to claim 15 wherein said providing step comprises providing the contour surface of the strongback extending continuously in a generally longitudinal direction from a first end of the strongback to a second end of the strongback.

17. A method according to claim 16 wherein said providing step comprises providing the continuous contour surface of the strongback with a sinusoidal contour having a plurality of minimums and maximums.

18. A method according to claim 17 wherein said providing step comprises providing the forming surface of each die corresponding to about one sinusoidal cycle of the contour surface of the strongback.

19. A method according to claim 15 wherein said adjusting step comprises independently adjusting each of the dies toward the strongback such that a plurality of corrugations is successively formed in the web.

20. A method according to claim 15 wherein said providing step comprises providing at least three of the dies arranged in a side-by-side configuration, the forming surfaces of the dies extending in a longitudinal direction of the strongback, the apparatus being configured to receive a linear web member between the forming surfaces of the dies and the contour surface of the strongback when the dies are in the retracted position.

21. A method according to claim 15 wherein said adjusting step comprises adjusting each die along a linearly adjustable track defined by the support structure in a direction generally perpendicular to a longitudinal direction of the strongback between the retracted and advanced positions.

22. A method according to claim 15 wherein said providing step comprises providing a radius of curvature along the forming surface of each die that is different than a radius of curvature at a corresponding location along the contour surface of the strongback such that the forming surfaces of the dies are offset from the contour surface of the strongback by a uniform distance when each of the dies is advanced toward the strongback.

23. A method according to claim 15 wherein said adjusting step comprises controlling an adjustment of the dies with a controller to automatically adjust the dies toward the strongback in a predetermined order.

24. A method according to claim 15 wherein said welding step comprises moving a welding tool along the edge of the web generally along a longitudinal direction of the support structure.

25. A method according to claim 24 wherein said welding step comprises adjusting at least one of a power and speed of motion of the welding tool to thereby control the operation of the welding tool according to at least one of a location of the welding tool along the support structure and a physical parameter of the stringer along the length thereof.

26. A method according to claim 24 wherein said welding step comprises laser welding each flange to the web by providing a laser beam on each flange at a position opposite the web.

27. A method according to claim 24 wherein said welding step comprises:

adjusting a gas chamber along a length of the strongback with the welding tool, the gas chamber defining an opening directed toward one of the flanges and the web supported by the strongback and dies; and delivering a gas to the gas chamber during operation of the welding tool such that the chamber is maintained substantially full of the gas and each flange is welded to the web in a local environment of the gas.

28. A method according to claim 15 wherein said welding step comprises delivering a gas into channels defined by the strongback and dies extending in the longitudinal direction of the apparatus.

* * * * *

UNITED STATES PATENT AND TRADEMARK OFFICE

CERTIFICATE OF CORRECTION

PATENT NO. : 7,642,481 B2
APPLICATION NO. : 11/464650
DATED : January 5, 2010
INVENTOR(S) : Kismarton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 669 days.

Signed and Sealed this

Sixteenth Day of November, 2010

David J. Kappos

David J. Kappos
*Director of the United States Patent and Trademark Office*